US006729382B2

(12) United States Patent
Parola

(10) Patent No.: US 6,729,382 B2
(45) Date of Patent: May 4, 2004

(54) CONDENSER FOR VEHICLE AIR-CONDITIONING SYSTEMS

(75) Inventor: Andrea Parola, Chieri (IT)

(73) Assignee: Denso Thermal Systems SpA, Poirino (IT)

( * ) Notice: Subject to any disclaimer, the term of this patent is extended or adjusted under 35 U.S.C. 154(b) by 0 days.

(21) Appl. No.: 10/183,385

(22) Filed: Jun. 28, 2002

(65) Prior Publication Data

US 2003/0000685 A1 Jan. 2, 2003

(30) Foreign Application Priority Data

Jun. 29, 2001 (IT) ..... TO2001A0629

(51) Int. Cl.[7] ..... F28F 9/00

(52) U.S. Cl. ..... 165/67; 165/906; 165/149; 165/173; 180/68.4

(58) Field of Search ..... 165/67, 149, 173, 165/906, 480; 180/68.4

(56) References Cited

U.S. PATENT DOCUMENTS

| | | | | | |
|---|---|---|---|---|---|
| 1,357,597 | A | * | 11/1920 | Spinger | 165/149 |
| 1,906,969 | A | * | 5/1933 | Ihde | 180/68.4 |
| 4,876,778 | A | * | 10/1989 | Hagihara et al. | 29/890.046 |
| 5,555,930 | A | | 9/1996 | Lu | |
| 5,678,628 | A | * | 10/1997 | Aki et al. | 165/173 |
| 5,954,123 | A | * | 9/1999 | Richardson | 165/81 |
| 6,006,430 | A | * | 12/1999 | Fukuoka et al. | 29/890.03 |
| 6,129,142 | A | * | 10/2000 | Beldam | 165/81 |
| 6,328,098 | B1 | * | 12/2001 | Kodumudi et al. | 165/149 |

FOREIGN PATENT DOCUMENTS

| | | | | |
|---|---|---|---|---|
| GB | 2 064 751 | | 6/1981 | |
| GB | 2064751 | A * | 6/1981 | 165/149 |
| JP | 403225197 | A * | 10/1991 | 165/149 |
| JP | 5-157484 | | 6/1993 | |

* cited by examiner

*Primary Examiner*—Terrell L McKinnon
(74) *Attorney, Agent, or Firm*—Sughrue Mion, PLLC

(57) ABSTRACT

A condenser for vehicle air-conditioning systems, comprising a pair of parallel distributors (12) between which there is set a heat-exchange core (14) including a plurality of pipes (16) having a flat cross section, which are parallel to one another, and a plurality of undulated fins (18) set between each pair of adjacent pipes, in which a reinforcing element (22) is applied on at least one end side (20) of the heat-exchange core (14). The aforesaid reinforcing element (22) is fixed directly on an end pipe (16*a*) of the heat-exchange core (14).

4 Claims, 2 Drawing Sheets

12
16a
24
22
16
28
26
18
III

CONDENSER FOR VEHICLE AIR-CONDITIONING SYSTEMS

TEXT OF DESCRIPTION

The present invention relates to a condenser for vehicle air-conditioning systems. More precisely, the invention relates to a condenser comprising a pair of parallel distributors between which is set a heat-exchange core including a plurality of pipes having a flat cross section, which are parallel to one another, and a plurality of undulated fins set between each pair of adjacent pipes. In condensers of this type, a reinforcing element is applied on at least one end side of the heat-exchange core. In known solutions, the heat-exchange core terminates, on each of its sides, with an undulated fin fixed to the respective end pipe, and the reinforcing element is fixed on said fin.

The purpose of the present invention is to provide a condenser of an improved type which, given the same level of performance, is simpler and less costly than a condenser according to the prior art.

In accordance with the present invention, the above purpose is achieved by a condenser having the characteristics that form the subject of the main claim.

In the solution according to the present invention, the reinforcing element is fixed directly on the end pipe of the heat-exchange core, without any undulated fin being set between a pipe and the reinforcing element. The present invention stems from the realization of the fact that the undulated fins set at the ends of the heat-exchange core practically do not have any effect in terms of heat-exchange performance of the condenser because, when the condenser is mounted on a vehicle, the said fins are often covered and are not impinged upon by the flow of air. Consequently, the end fins can be eliminated, and the reinforcing element can be set directly in contact with the outer surface of the end pipe, without there being any reduction in the performance of the heat exchanger.

The solution according to the present invention makes it possible to obtain a reduction in the weight and number of components, as well as a reduction in the cost of the raw materials and a reduction in assembly-cycle time. Preferably, the reinforcing element has an undulated shape and is provided with holes for fixing the brackets for anchorage of the condenser. In the case where it is not necessary to fix the anchoring brackets to the reinforcing elements, the solution according to the invention makes it possible to obtain, as compared to a condenser according to the prior art with equal characteristics, a reduction in the overall dimensions, or else an increase in the level of performance, thanks to the possibility of adding a pipe, given the same overall dimensions.

The present invention will now be described in detail with reference to the attached drawings, which are provided purely by way of non-limiting example and in which.

Figure 1:
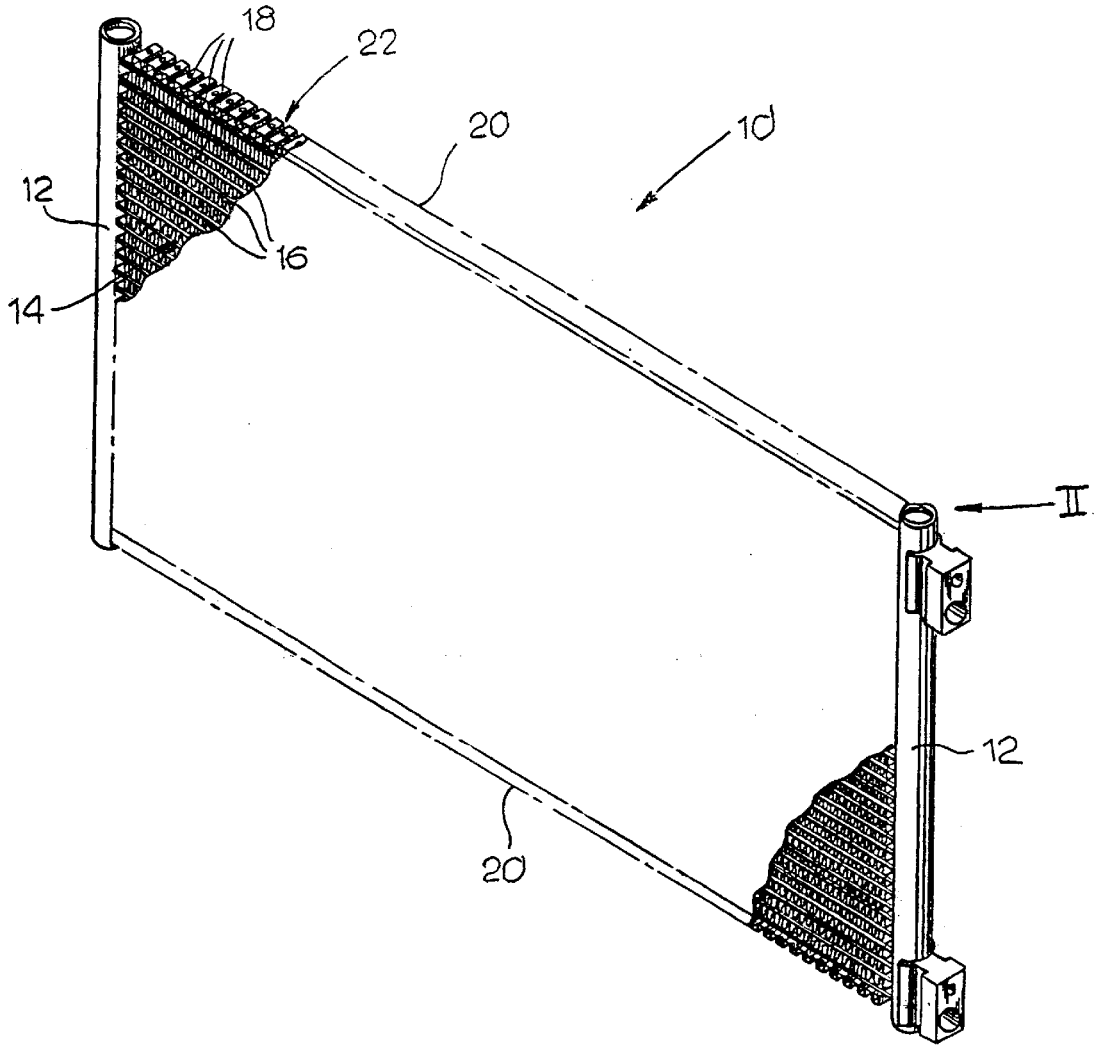
FIG. 1 is a schematic perspective view of a condenser according to the present invention.

With reference to the figures, number 10 designates a condenser for vehicle air-conditioning systems. The condenser 10 comprises a pair of tubular distributors 12 between which is set a heat-exchange core 14 comprising a plurality of pipes having a flat cross section, the ends of which are fixed to the distributors 12 and are set in fluid communication with the latter. The heat-exchange core 14 comprises a plurality of heat-exchange fins 18 formed by thin undulated aluminium strips, which are set between each pair of adjacent pipes. The assembly made up of the pipes 16, the undulated fins 18, and the distributors 12 is obtained according to a technology in itself known, which envisages preliminary assembly by tacking of the various components and, in a subsequent step, fixing of the various components together by oven brazing. In a way in itself known, the pipes 16 and distributors 12 are provided, on their outer surfaces, with a layer of brazing alloy which, during passage through the oven, ensures fixing between the pipes and the fins and between the pipes and the distributors.

Figures 2, 3:
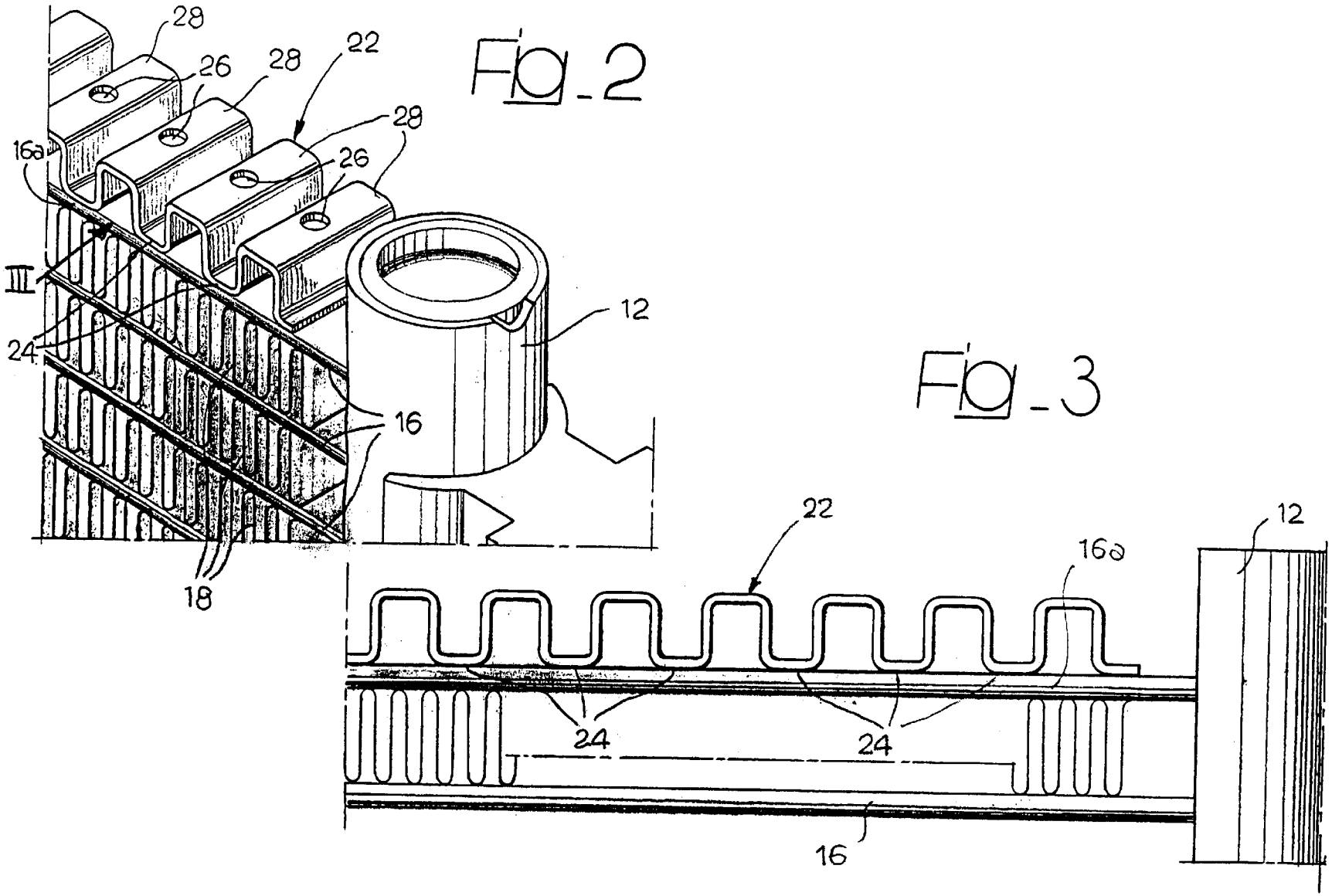
FIG. 2 is a perspective view of the part indicated by the arrow II in FIG. 1.
FIG. 3 is a partial front elevation of the part indicated by the arrow III in FIG. 2.

The heat-exchange core 14 has two end sides 20 which are parallel to the pipes 16 and along which respective reinforcing elements 22 are applied. As illustrated in FIGS. 2 and 3, each reinforcing element 22 consists of a metal element obtained by pressing or rolling and preferably having an undulated shape. The reinforcing elements 22 have a thickness considerably greater than the thickness of the undulated fins 18. Each protective element 22 is fixed to the respective end tube 16*a* during the oven-brazing operation itself that produces fixing between the tubes, fins and distributors. The reinforcing element 22 basically extends throughout the length of the pipe 16*a* and is fixed to the latter along the surfaces of mutual contact, designated by 24 in FIGS. 2 and 3. Preferably, the reinforcing element 22 is provided with holes 26 formed on plane portions 28 set at some distance from the outer surface of the pipe 16*a*. The holes 26 can be used for fixing anchoring brackets (not illustrated) for fastening the condenser 10 to the structure of the vehicle or of the radiator set behind the condenser. The anchoring brackets can be fixed to the reinforcing element 22 by means of a simple riveting operation.

The reinforcing element 22 has, as its main purpose, that of protecting the end tube 16*a* from any impact that might perforate the tube. The undulated shape of the reinforcing element 22 makes it possible to increase the characteristics of stiffness thereof. In addition, the reinforcing element 22 contributes, even though to a minimal extent, to the heat exchange with the flow of air which, during use, impinges upon the condenser 10.

What is claimed is:

1. A condenser for vehicle air-conditioning systems, comprising a pair of parallel distributors;

a heat-exchange core set between said parallel distributors and including a plurality of tubes parallel to one another having a flat cross section, and a plurality of undulated fins set between each pair of adjacent tubes and defining air passageways orthogonal to said tubes; and a reinforcing element applied on at least one end side of the heat-exchange core, said reinforcing element having an undulated shape defining air passageways parallel to the air passages of the undulated fins, the undulated reinforcing element having spaced apart surfaces of mutual contact with an outer surface of an end pipe and being directly fixed to said end pipe at said spaced apart surfaces of mutual contact.

2. The condenser according to claim 1, wherein the undulated reinforcing element is formed by a metal element bent into a succession of substantially square waves.

3. The condenser according to claim 2, wherein said square waves have flat inner portions defining said surfaces of mutual contact.

4. The condenser according to claim 2, wherein said square waves have flat outer portions provided with holes.

* * * * *